US006119278A

United States Patent [19]

Kawashima

[11] Patent Number: 6,119,278

[45] Date of Patent: Sep. 19, 2000

[54] SWIMMING GOGGLES

[75] Inventor: Haruo Kawashima, Tokyo, Japan

[73] Assignee: Tabata Co., Ltd., Tokyo, Japan

[21] Appl. No.: 09/292,514

[22] Filed: Apr. 15, 1999

[30] Foreign Application Priority Data

Apr. 16, 1998 [JP] Japan ..... 10-106730

[51] Int. Cl.[7] ..... A61F 9/02

[52] U.S. Cl. ..... 2/428; 2/445

[58] Field of Search ..... 2/428, 430, 445, 2/446, 440, 454; 351/126, 128, 124

[56] References Cited

U.S. PATENT DOCUMENTS

| | | | |
|---|---|---|---|
| 5,596,771 | 1/1997 | Hsu | 2/428 |
| 5,687,428 | 11/1997 | Yamamoto | 2/445 |
| 5,896,588 | 4/1999 | Chiang | 2/428 |

FOREIGN PATENT DOCUMENTS 7-28577 5/1995 Japan .

*Primary Examiner*—Peter Nerbun

*Attorney, Agent, or Firm*—Barnes & Thornburg

[57] ABSTRACT

Swimming goggles include a pair of lenses, a pair of lens frame members each supporting one of the lenses, a bridge belt by which respective inner edges of the lens frame members are connected to each other, and a head band extending between respective outer edges of the lens frame members. The lens frame members are provided adjacent their inner edges with coupling means adapted for releasably receiving stoppers formed on the bridge belt so that a distance between the inner edges can be adjusted. The bridge belt is formed on its inner surface with pairs of the stoppers arranged symmetrically with a center line longitudinally dividing the bridge belt in two. The bridge belt is made of a plastically deformable material and a portion of the bridge belt defined between a pair of the symmetrically arranged stoppers is formed on its inner surface with grooves extending transversely of the bridge belt.

4 Claims, 4 Drawing Sheets

SWIMMING GOGGLES

BACKGROUND OF THE INVENTION

This present invention relates to swimming goggles used during swimming or the like and, more particularly, to such swimming goggles provided with a bridge belt allowing a distance between respective inner edges of a pair of lens frame members to be adjusted.

Japanese Utility Model Application Disclosure Gazette No. Hei7-28577 discloses an arrangement adapted to adjust a distance between respective inner edges of a pair of lens frame members in swimming goggles. In the swimming goggles therein disclosed, the pair of lens frame members are connected to each other by a linear bridge belt made of a soft elastic material. Each of the lens frame members is formed adjacent its inner edge with a locking pawl, on one hand, and the bridge belt is formed with a plurality of projections successively arranged in a longitudinal direction of the bridge belt, on the other hand. The plurality of projections are adapted to selectively and releasably engage the locking pawl. By appropriately selecting one of the projections to engage the locking pawl, the distance between the respective inner edges of the lens frame members is adjusted.

The bridge belt connecting the pair of lens frame members describes a line which is convexly curved from a rear side towards a front side of the lenses.

With the known swimming goggles, elasticity of the bridge belt tending to restore the bridge belt from its curved position to its initial linear position may move the respective outer edges of the lens frame members away from a wearer's face. Due to such tendency, it may sometimes be difficult for a swimmer to wear the goggles quickly. After the swimming goggles have been worn, a shock of diving or the like causes the lens frame members to slip out of proper place unless the bridge belt is maintained under adequate tension.

SUMMARY OF THE INVENTION

In view of the problem as has been described above, it is an object of the present invention to improve a bridge belt of swimming goggles so as to be easily worn and to be free from an inconvenience that the swimming goggles slip out of place during actual use thereof.

According to the invention, there is provided swimming goggles comprising a pair of lens frames each holding a lens; a bridge belt adapted to connect mutually opposed inner edges of the lens frames to each other; the lens frames being provided at the inner edges thereof with coupling means; the bridge belt being formed on an inner surface thereof facing a wearer with a plurality of stoppers arranged symmetrically with respect to a center line longitudinally dividing the bridge belt in two so that the stoppers can releasably and selectively engage the coupling means; the bridge belt being made of a plastically deformable material and a portion of the bridge belt defined between a pair of the stoppers arranged most closely to the center line being formed on the inner surface of the bridge belt with at least one groove extending transversely of the bridge belt so that the bridge belt can be bent along the groove and maintained in the bent position under the effect of plastic deformation; and the bridge belt having the smallest thickness at a bottom of the groove.

According to an embodiment of the present invention, a depth of the groove is selected in a range of 2/3~9/10 a thickness of the bridge belt as measured in the vicinity of the groove.

According to another embodiment of the present invention, the bridge belt is formed on an inner surface thereof with a pair of grooves arranged symmetrically with respect to the center line.

According to still another embodiment of the present invention, a single groove is formed on an inner surface of the bridge belt along said center line.

According to the present invention, the bridge belt of the swimming goggles can be plastically deformed along the groove or grooves so as to be maintained in its position thus deformed. Consequently, elasticity of the bridge belt advantageously prevents outer edges of the lens frame members from moving away from the wearer s face once the swimming goggles have been put on the wearer's head. The plastically deformed bridge belt reliably maintains the distance between the pair of lens frame members and thereby eliminates any apprehension that a shock of diving causes the pair of lens frame members to slip out of their properly adjusted position established before diving.

DETAILED DESCRIPTION OF THE PREFERRED EMBODIMENTS

Details of swimming goggles according to the invention will be more fully understood from the description given hereunder with reference to the accompanying drawings.

Figure 1:
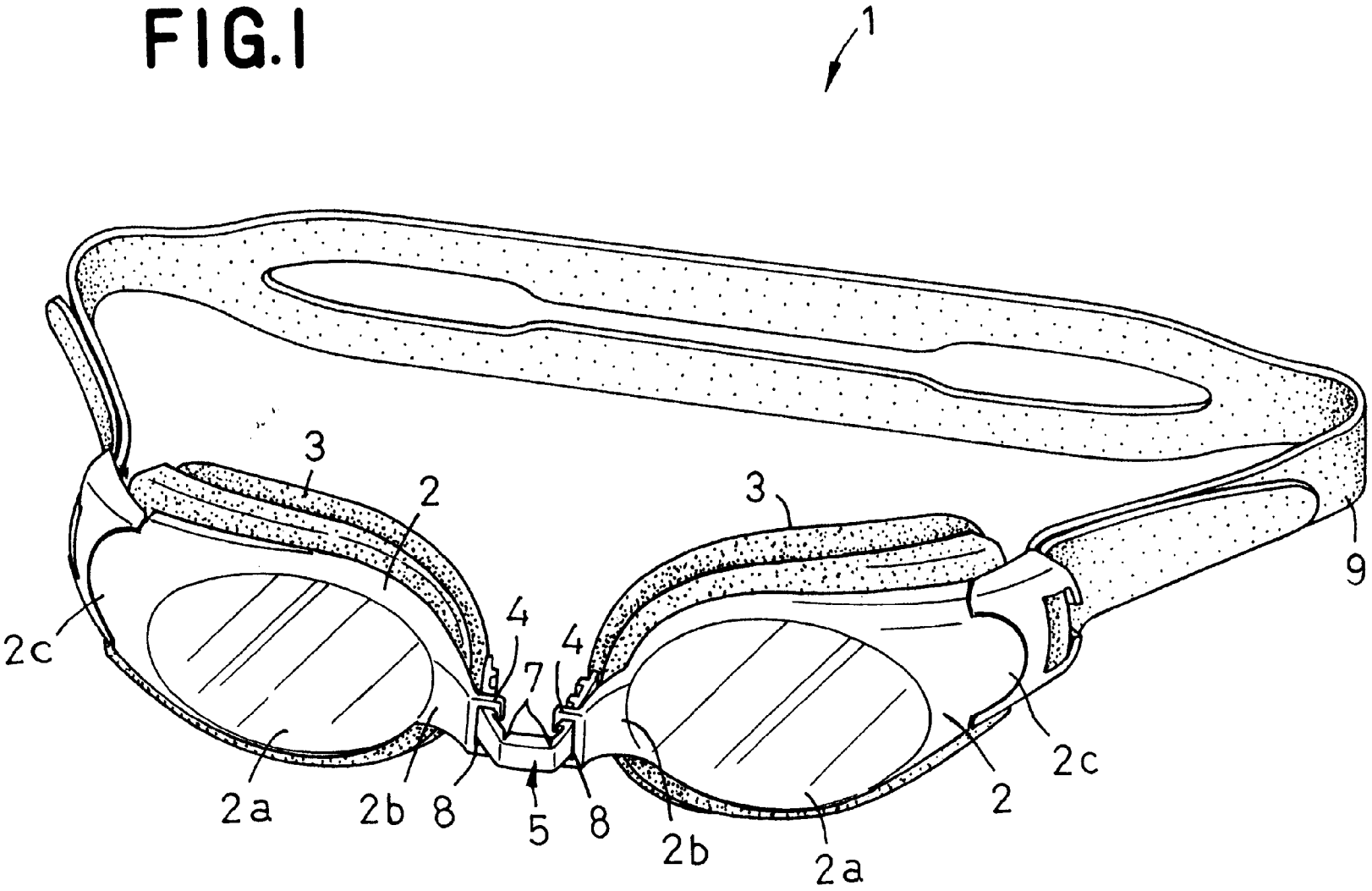
FIG. 1 is a perspective view of swimming goggles constructed according to one embodiment of the present invention.
Figure 2:
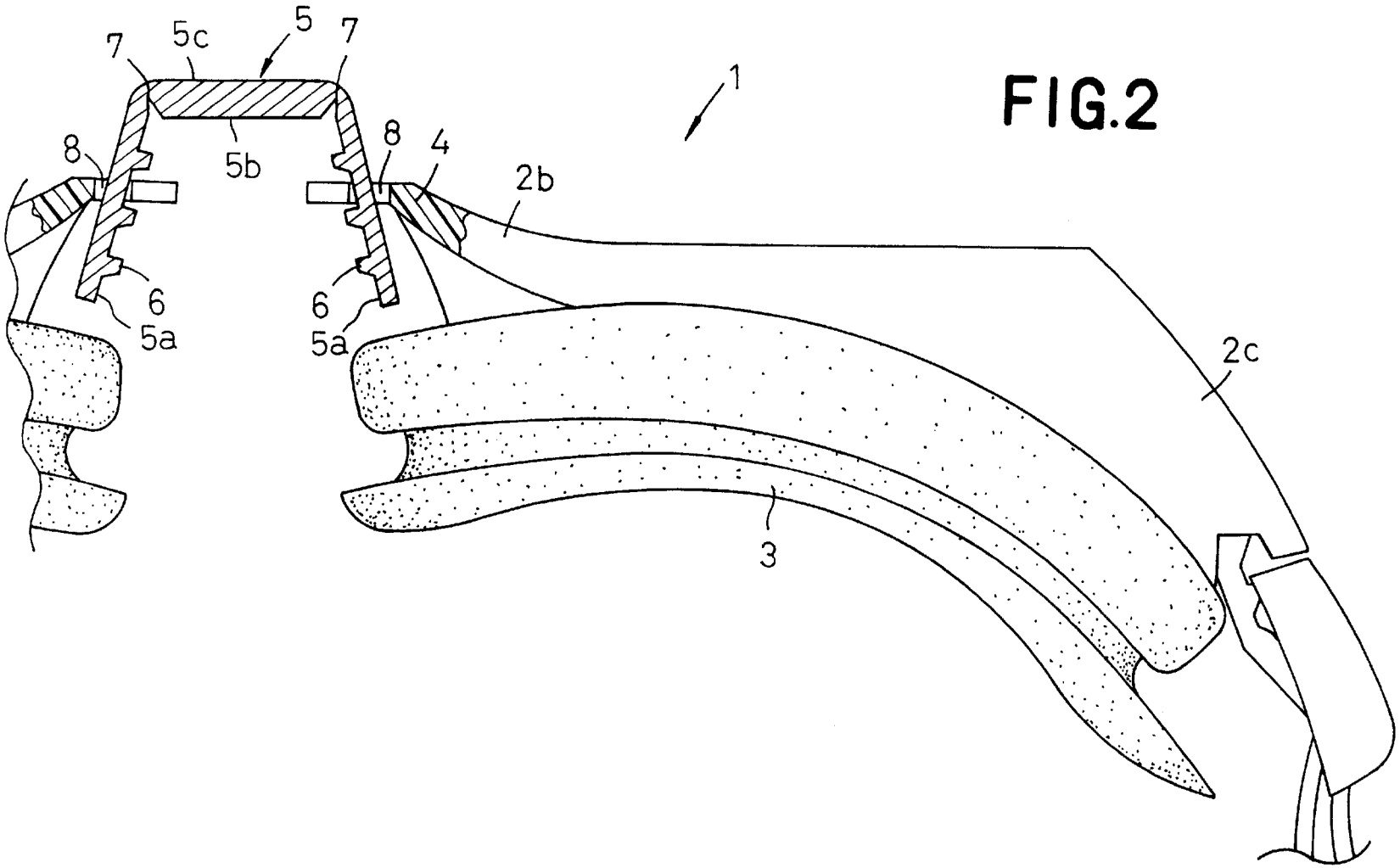
FIG. 2 is a fragmentary side view showing the swimming goggles as partially broken away.

FIG. 1 is a perspective view of swimming goggles 1 and FIG. 2 is a fragmentary side view showing the swimming goggles 1 as partially broken away.

The swimming goggles 1 comprise a pair of lens frame members 2 each formed integrally with a lens 2*a,* a pair of face pads 3 mounted around the lens frame members 2, respectively, a bridge belt 5 connecting respective inner edges 2*b* of the lens frame members 2 to each other and a head band 9 connecting respective outer edges 2*c* of the lens frame members 2 to each other. Each of the lens frame members 2 has an arm 4 extending from its own inner edge 2*b* towards the inner edge 2*b* of the other lens frame member 2. Each of the arms 4 is formed adjacent its distal end with a coupling-hole 8 so that each of longitudinally opposite portions of the bridge belt 5 extending substantially in parallel to an optical axis of the lens 2*a* can be detachably inserted into the coupling hole 8. Though not shown, the coupling hole 8 is partially cut away, i.e., chamfered in order to facilitate insertion of the bridge belt 5 thereinto.

Figure 3:
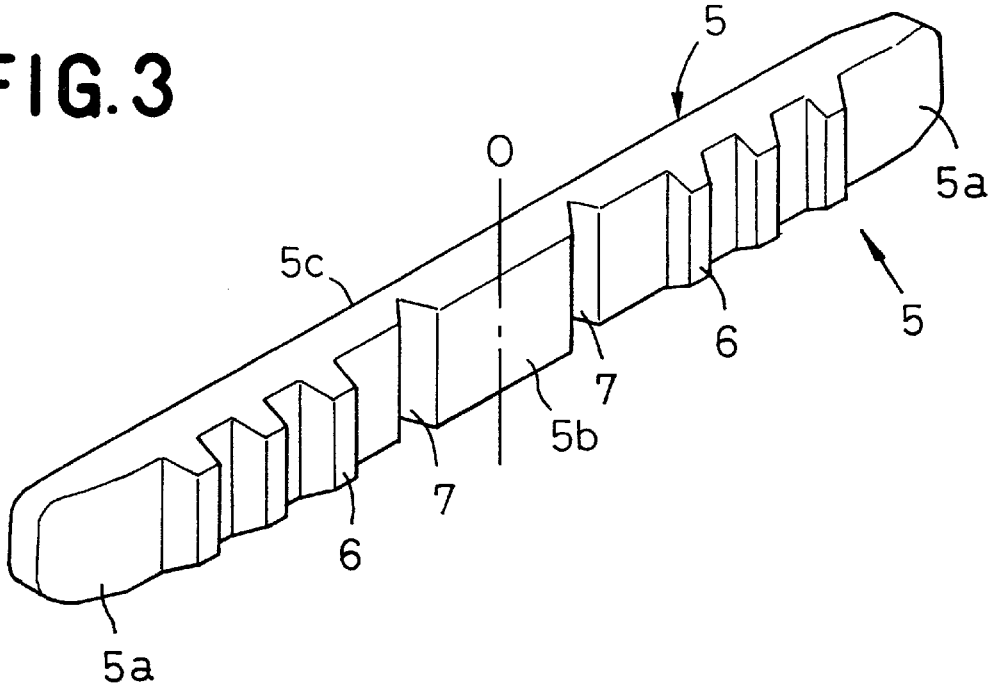
FIG. 3 is a perspective view of a bridge belt adopted in the swimming goggles shown by FIG. 1.
Figure 4:
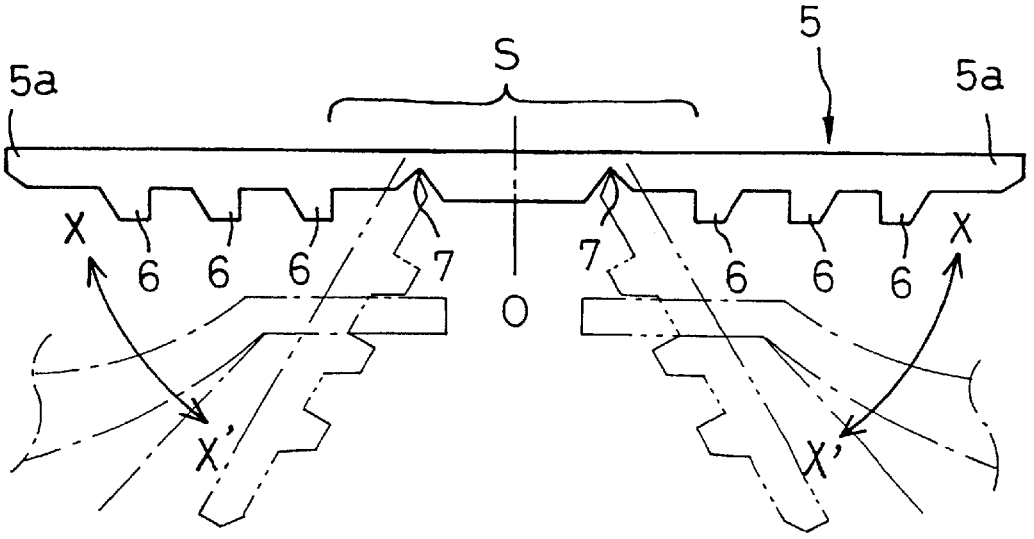
FIG. 4 is a side view showing the bridge belt in its bent position as indicated by imaginary lines.

FIG. 3 is a perspective view of the bridge belt 5 adopted in the swimming goggles 1 and FIG. 4 is a side view showing the bridge belt 5 in its bent position as indicated by imaginary lines.

Referring to FIGS. 3 and 4, the bridge belt 5 is a linear member made of a plastically deformable material such as polyurethane or polyethylene. The bridge belt 5 is formed on its inner surface with three pairs of stopper projections 6. These three pairs of stopper projections 6 are symmetrically arranged with respect to a transversely extending center line 0 of the bridge belt 5 successively at regular intervals towards longitudinally opposite ends thereof. These stopper projections 6 are dimensioned to be slightly larger than the coupling holes 8 of the lens frame members 2 so that they can be elastically deformed to pass through the coupling holes 8. The number of these stopper projections 8 is not limited to three pairs as in this specific embodiment shown and may be selected depending on a desired adjustability of a distance between the inner edges 2*b*. It should be understood that the surface herein referred to as "inner surface 5*b*" is the surface of the bridge belt 5 facing a wearer and the surface herein referred to as "outer surface 5*c*" is the surface opposed to the inner surface 5*b*. The bridge belt 5 is provided at its portion S defined between the pair of stopper projections 6 lying most closely to the center line 0 with a pair of grooves 7 which are V-shaped in their cross-sections and which allow the bridge belt 5 to be plastically deformed so as to be bent from the side corresponding to the outer surface 5*c* towards the side corresponding to the inner surface 5*b* with respect to the initial linear position of the bridge belt 5. These grooves 7 extend orthogonally to the longitudinal direction of the bridge belt 5 and are arranged symmetrically with respect to the center line 0 so as to be spaced from the center line towards the opposite ends 5*a*, respectively. The depth of each groove 7 is smaller than a thickness of the portion S exclusive of the grooves 7. Preferably, the depth of each groove 7 is in a range of 2/3~9/10 thickness of the bridge belt 5 in order that the bridge belt 5 can be easily bent along the respective grooves 7.

Now an operation of the embodiment as has been described above will be discussed. The pair of lens frame members 2 are connected to each other via the bridge belt 5 which is then bent from its front side towards its rear side along the grooves 7. In this state, the middle portion of the bridge belt 5 defined between the pair of grooves 7 longitudinally extends substantially in parallel to front surfaces of the respective lenses 2*a* and the portions extending from the respective grooves 7 to the respective longitudinal ends obliquely extend rearwardly of the respective lenses 2*a*. The bridge belt 5 can be maintained in its bent position since the bridge belt 5 is plastically deformable along the respective grooves 7. A distance between the inner ends 2*b* of the respective lens frame members 2 can be adjusted by selecting the stopper projections 6 as well as selecting the angle at which the bridge belt 5 is bent.

Figure 5:
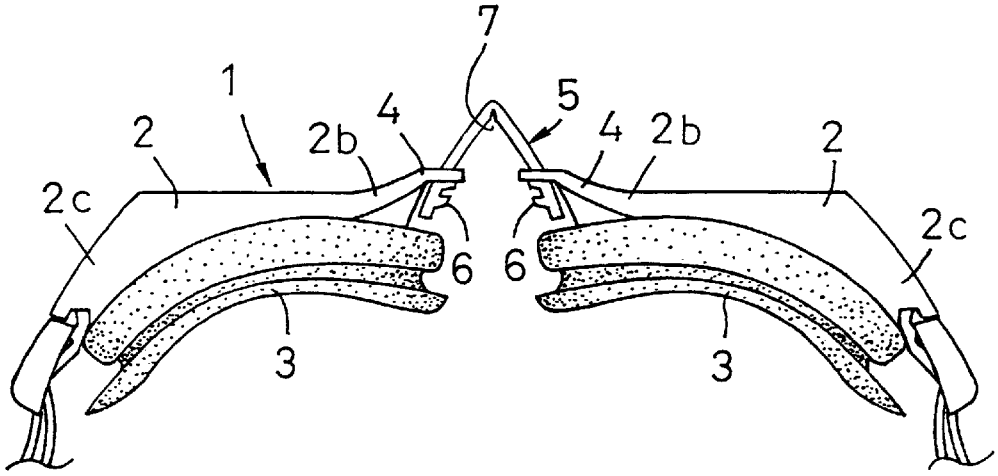
FIG. 5 is a fragmentary side view of the swimming goggles adopting a bridge belt constructed in a manner different from the bridge belt shown in FIG. 1.
Figure 6:
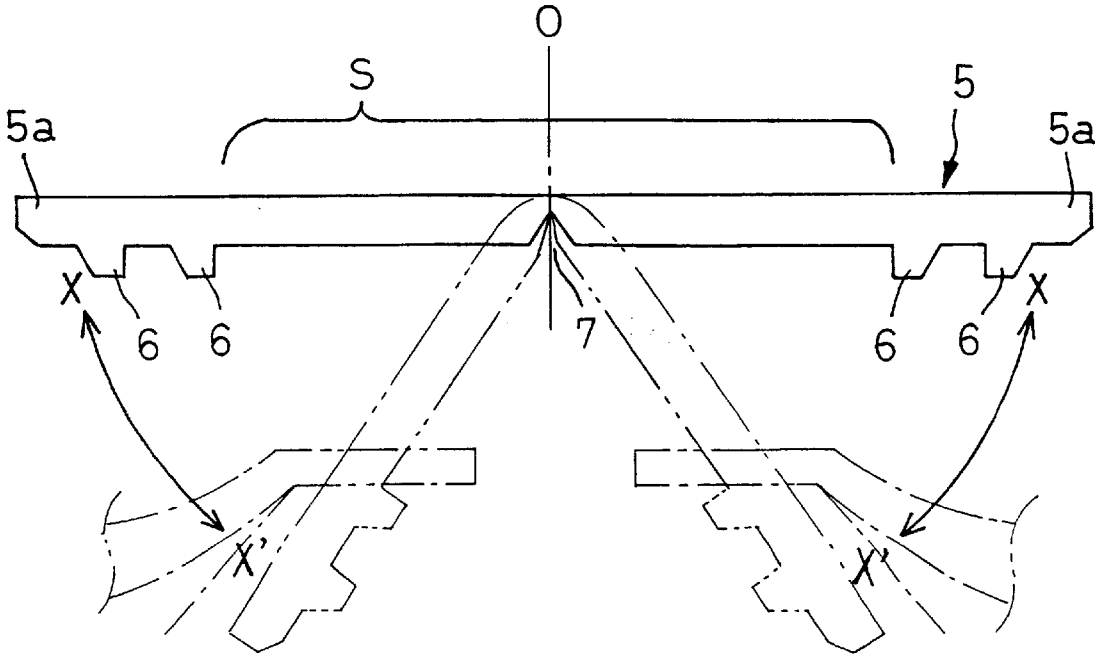
FIG. 6 is a side view of the bridge belt shown in FIG. 5 in its bent position as indicated by imaginary lines.

FIG. 5 is a fragmentary side view of the swimming goggles 1 adopting a bridge belt 5 constructed in a manner different from the bridge belt 5 adopted in the swimming goggles 1 shown by FIG. 1. FIG. 6 is a side view showing this bridge belt 1 in its bent position as indicated by imaginary lines.

According to this alternative embodiment, the bridge belt 5 is formed on its inner surface 5*b* with two pairs of stopper projections 6 arranged symmetrically with respect to the center line 0 successively towards the longitudinally opposite ends 5*a*. The bridge belt 5 is formed also on its inner surface 5*b* in alignment with the center line 0 with a single groove 7 shaped in a trapezoidal cross-section and extending orthogonally to the longitudinal direction of the bridge belt 5. Along this single groove 7, the bridge belt 5 can be plastically deformed to be bent in the direction from the side corresponding to its outer surface 5*c* towards the side corresponding to its inner surface 5*b* with respect to the initial linear position of the bridge belt 5. As in the previous embodiment of the bridge belt 5 shown in FIG. 1, the depth of the groove 7 is smaller than a thickness of said portion S exclusive of the groove 7. Preferably, the the depth of the groove 7 is selected in a range from 2/3~9/10 of the thickness of the bridge belt 5. In operation, the pair of lens frame members 2 are connected to each other by means of the bridge belt 5 which is then bent along the groove 7 in the direction from the side corresponding to the outer surface towards the side corresponding to the inner surface of the bridge belt 5. As a result, the bridge belt 5 maintained in its bent position under the effect of plastic deformation along the groove 7 and the initial linear bridge belt 5 presents a V-shape which is convex forwardly of the lens frame members 2.

According to the invention, the bridge belt of the swimming goggles can be plastically deformed along the groove or grooves so as to be maintained in its position thus deformed. Consequently, an elasticity of the bridge belt advantageously prevents the outer edges of the lens frame members from moving away from the wearer's face once the swimming goggles have been put on the wearer's head. The plastically deformed bridge belt reliably maintains the distance between the pair of lens frame members and thereby eliminates any apprehension that a shock of diving might cause the pair of lens frame members to slip out of their properly adjusted position established before diving.

What is claimed is:

1. Swimming goggles comprising:

a pair of lens frames each supporting a lens;

a bridge belt for adjustably coupling mutually opposed inner edges of said pair of lens frames to each other;

said pair of lens frames being provided at said inner edges with coupling means;

said bridge belt being formed with a plurality of stoppers arranged symmetrically with respect to a center line longitudinally dividing said bridge belt in two so that said plurality of stoppers can releasably and selectively engage said coupling means;

said bridge belt being made of a plastically deformable material and a portion of said bridge belt defined between a pair of said plurality of stoppers arranged most closely to said center line being formed on an inner surface of said bridge belt with at least one groove extending transversely of said bridge belt so that said bridge belt can be bent along said at least one groove and maintained in a bent position under the effect of plastic deformation; and said bridge belt having a smallest thickness at a bottom of said at least one groove.

2. Swimming goggles according to claim 1, wherein said at least one groove has a depth within a range of 2/3~9/10 of a thickness of the bridge belt as measured in a vicinity of said at least one groove.

3. Swimming goggles according to claim 1, wherein said at least one groove comprises a pair of grooves which are arranged symmetrically with respect to said center line.

4. Swimming goggles according to claim 1, wherein said at least one groove comprises a single groove which is aligned with said center line.

* * * * *